United States Patent [19]

Arnold

[11] Patent Number: 5,015,112

[45] Date of Patent: May 14, 1991

[54] COOKING OIL CONTAINER AND APPLICATOR

[76] Inventor: Nanci N. Arnold, 4735 W. Lake Rd., Canandaigua, N.Y. 14424

[21] Appl. No.: 531,136

[22] Filed: May 31, 1990

[51] Int. Cl.[5] ..... B05C 17/00

[52] U.S. Cl. ..... 401/202; 401/196

[58] Field of Search ..... 401/199, 202, 207, 196, 401/286, 282, 198, 15

[56] References Cited

U.S. PATENT DOCUMENTS

| | | | |
|---|---|---|---|
| 346,088 | 7/1886 | Cahoone | 401/202 |
| 388,823 | 9/1888 | Bush | 401/198 |
| 430,619 | 6/1890 | Cahoone | 401/207 |
| 441,142 | 1/1891 | Stafford | 401/207 |
| 475,693 | 5/1892 | Macphail | 401/207 |
| 1,021,522 | 3/1912 | Hinsdale | 401/202 |
| 4,747,720 | 5/1988 | Bellehumeur | 401/207 |

*Primary Examiner*—Richard J. Johnson
*Attorney, Agent, or Firm*—Robert J. Bird

[57] ABSTRACT

The disclosed combination includes an oil container, an applicator assembly, and a removable cap. The applicator assembly includes a tube through the top of the container, a drain receptacle surrounding the tube above the container, and a porous applicator tip on the drain receptacle and over the end of the tube. Oil flows through the tube, to and from the applicator tip. One applicator tip includes ridges with a channel or groove between them. Another has a periphery with convex and concave portions. These tip configurations facilitate oiling of various surfaces. The device is effective to provide oil to the tip for application of a film of oil on a desired surface, and to drain excess oil from the tip back into the container.

3 Claims, 2 Drawing Sheets

COOKING OIL CONTAINER AND APPLICATOR

FIELD OF THE INVENTION

The subject of this invention is a container and applicator for oil. More specifically, the invention is a combination container and applicator for applying a film of cooking oil to a cooking surface.

BACKGROUND INFORMATION

Cooking surfaces such as frying pans are usually greased with cooking oil or with a solid such as butter or margarine to provide a non-stick cooking surface. The solids are applied with a knife or spatula. Oil is usually poured from a bottle, or sprayed from a pressurized spray can. Oil poured from a bottle is not directed at a precise area, but instead flows over the entire cooking surface. Spray cans are wasteful, potentially dangerous when used near flame, environmentally harmful because of the necessary propellant, and a disposal problem. Barbeque grills are still another problem. They are often used without lubrication, so food often sticks to the grill rods. This is wasteful and troublesome.

It is an object of this invention to provide a combination container and applicator for applying a film of oil to a cooking surface to provide a non-stick cooking surface, and for applying the film selectively to a precise area without overcoating or wasteful spraying.

SUMMARY OF THE INVENTION

In summary, the present invention is a combination oil container and applicator assembly. The applicator assembly includes a tube through the top of the container, a drain receptacle surrounding the tube above the container, and a porous applicator tip on the drain receptacle and over the end of the tube. Oil flows through the tube, to and from the applicator tip. One applicator tip includes ridges with a channel or groove between them. Another has a periphery with convex and concave portions. These tip configurations facilitate oiling of various surfaces. The device is effective to provide oil to the tip for application of a film of oil on a desired surface, and to drain excess oil from the tip back into the container.

DRAWING

DESCRIPTION

Figure 1:
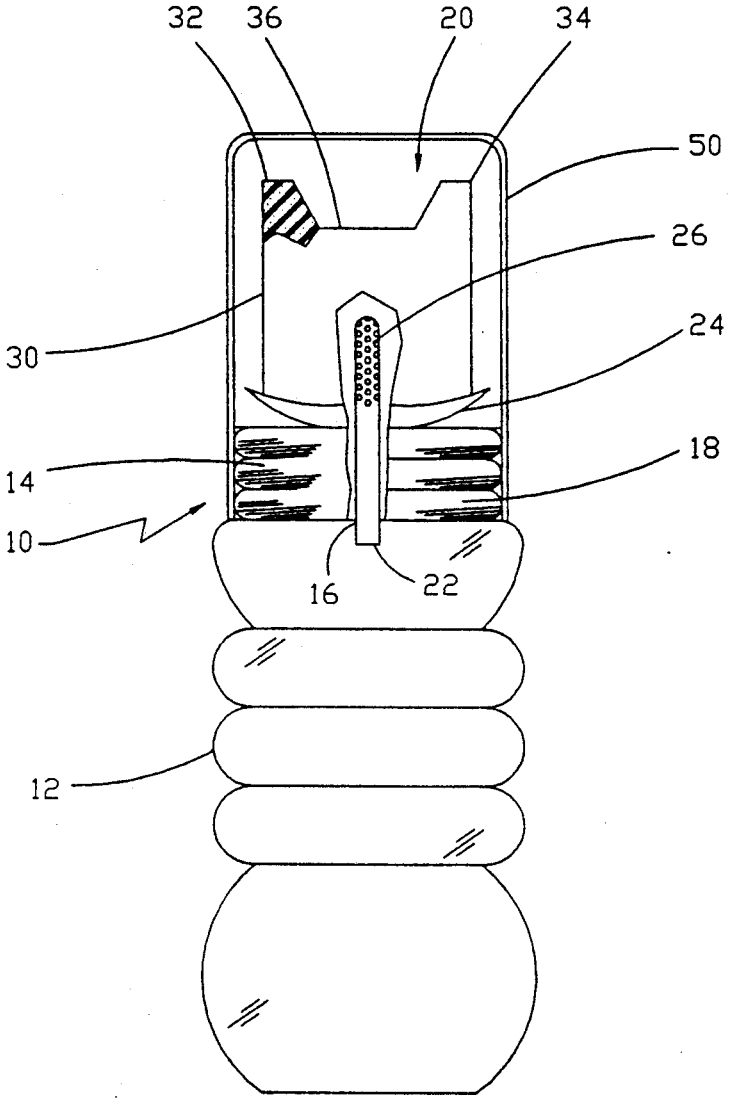
FIG. 1 is an elevation view of an oil container and applicator assembly according to this invention.
Figure 2:
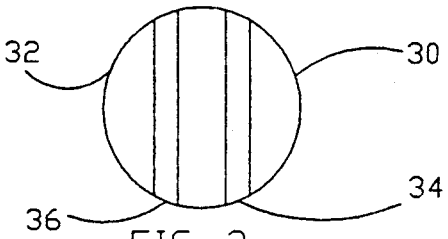
FIG. 2 is a top view of the applicator tip of FIG. 1.

Referring now to FIGS. 1 and 2, the combination oil container and applicator of this invention includes a container or reservoir portion 10, an applicator assembly 20, and a screw cap 50. The container 10 is preferably of clear plastic with a ridged sidewall 12 for convenient gripping. The container 10 includes a stopper or top wall 14. The stopper 14 might be a separate piece tightly fit within the top of the container 10, or it might be of the same molding as the container. The stopper 14 includes a central aperture 16. The container 10 also includes threads 18 for engagement with mating internal threads in the cap 50. The cap 50 is preferably of clear plastic, but might also be of metal.

The applicator assembly 20 includes a vertical tube 22, a horizontal drain receptacle 24 surrounding the tube 22 at a mid location between its ends, and an applicator tip 30 on the upper end of the tube 22. The tube 22 is open at its bottom end, and includes a number of orifices 26 through its upper wall, starting immediately above the drain receptacle 24. The tube 22 may be open or closed at its upper end. The horizontal drain receptacle 24 is saucer shaped, concave upward, and fits tightly over the tube 22. The vertical tube 22 in turn fits tightly within and through the aperture 16 in the stopper 14, and into the container 10. The drain receptacle 24 is external of the container 10.

The applicator tip 30 is mounted on the drain receptacle 24 and on the end of the tube 22. It is preferably fixed to the tube by an adhesive or glue, but may be held there simply by friction. The tip 30 is of a porous or sponge material to absorb and convey oil to and from the tube orifices 26 by wicking. The working end of the applicator tip 30 includes parallel ridges 32 and 34 and a transverse channel or groove 36 between them. The upper portion of the tube 22 is the "backbone" of the applicator tip 30, giving it support against lateral deformation while in use.

Figure 3:
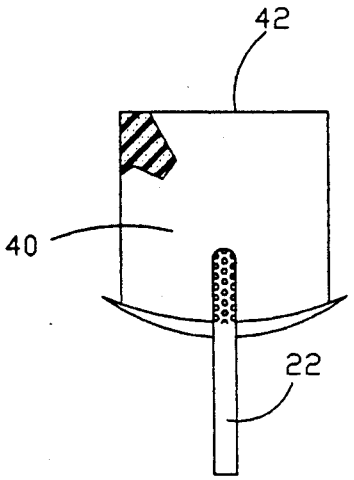
FIG. 3 is an elevation view of another form of applicator assembly.
Figure 4:
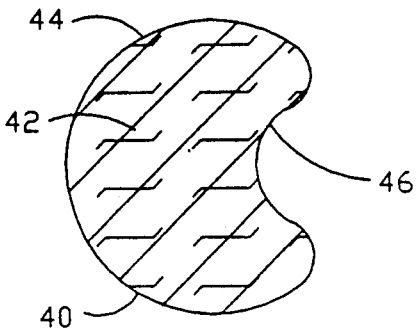
FIG. 4 is a top view of the applicator tip of FIG. 3.

FIGS. 3 and 4 show another form of the applicator assembly, similar to that shown in FIG. 1 except for the configuration of its applicator tip 40. The top surface 42 of the tip is flat. As seen in FIG. 4, its periphery is shaped to provide a convex side 44 and a concave side 46. The flat surface 42 and the convex side 44 are used to apply oil on extended surfaces. The concave side or groove 46 is for application of oil to grill rods and the like.

In operation, the user tilts or inverts the container 10 to allow oil to flow by gravity from the container through the tube 22 and its orifices 26 into the porous applicator tip. A film of oil from the tip is then applied to an extended cooking surface by moving the tip across the surface to cover the desired surface area with the desired film. If the cooking surface is a grill instead of an extended flat surface, the desired oil film is applied to individual grill rods by placing the channel or groove portion of the applicator tip over each rod and moving it along the rod as required. When the application of oil is complete and the container stood upright, oil remaining in the applicator tip drains from the tip onto the concave drain receptacle 24, through the tube orifices 26, and back into the container 10. The drain receptacle 24 collects and returns this oil to the tube 22 to prevent dripping from the device after its use.

Figure 5:
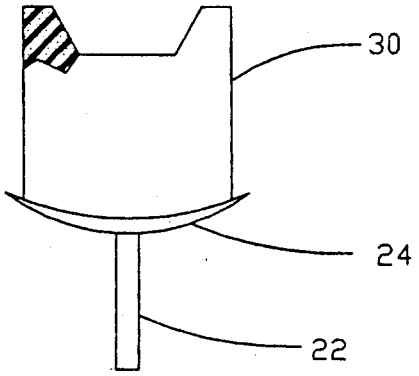
FIG. 5 is an elevation view of an applicator assembly according to a modified form of the invention.

A modified form of the applicator assembly 20 is shown in FIG. 5. In this form, the drain receptacle 24 is at the upper end of the tube 22, instead of at an intermediate location, and the applicator tip 30 is mounted on the receptacle alone. The oil flows to and from the applicator tip 30 straight through the end of the tube 22. This arrangement operates in the same way as described above. It is not the preferred form of the invention, however, because the applicator tip does not get the structural support or "backbone" which the upper portion of the tube 22 gives to the applicator tip in the arrangement of FIG. 1.

The combination container and applicator of this invention provides a safe, economical, and neat application of oil directly onto a cooking surface. The oil is easily applied on flat surfaces. It is also applied easily and without waste on broiler pans (which are apertured), and on barbeque grills (which are more aperture than surface). It is applied without wasteful spraying. The method is safe and environmentally acceptable. The container and applicator is also widely useful beyond the kitchen and for uses other than cooking. The application of a thin protective film of oil on tools and other metal surfaces is an especially appropriate use.

The applicator assembly 20 might be removable from the container 10 for refilling and reuse, or the assembly might be permanently fixed and sealed to the container to prevent reuse. The connections of the various pieces are intended to be liquid tight.

As an example of size, the container 10 might be one inch in diameter and four inches high, with a capacity of 2.5 to 3 ounces of oil. The working surface of the applicator tip might be one inch in length.

Terms such as "vertical", "horizontal", "upward", and the like are used herein with reference to the applicator device in its standing or rest position. They are terms of convenience to indicate relative attitudes of the structural elements.

The invention has been described with particular reference to its use for applying cooking oil to cooking surfaces. This is only for convenience. The environment and field of use of the invention are not limited by such description. The foregoing description of a preferred embodiment is intended as illustrative. The concept and scope of the invention are limited only by the following claims and equivalents thereof.

What is claimed is:

1. An applicator device for applying a film of oil, said device including a container having a top wall, and an applicator assembly connected thereto:

said applicator assembly including a perforated vertical tube extending upwardly through the above said top wall of said container, a concave upward drain receptacle mounted on said tube in sealing engagement therewith and extending radially therefrom above said container, and a porous applicator tip over the outer end of said tube and on said drain receptacle, said tube being in fluid communication with said drain receptacle, said drain receptacle extending radially outward of said applicator tip;

whereby said applicator device is effective to provide oil to said applicator tip for application of a film of said oil on a desired surface, and to drain oil from said applicator tip back into said container.

2. An applicator device for applying a film of oil, said device including a container having a top wall, and an applicator assembly connected thereto:

said applicator assembly including a vertical tube extending upwardly through said top wall of said container, a concave upward drain receptacle mounted on said tube in sealing engagement therewith and extending radially therefrom above said container, and a porous applicator tip over the outer end of said tube and on said drain receptacle, said tube being in fluid communication with said drain receptacle, said drain receptacle extending radially outward of said applicator tip;

said applicator tip including parallel ridges for application of oil to flat areas, said ridges defining a channel therebetween for application of oil to grill rods and the like;

whereby said applicator device is effective to provide oil to said applicator tip for application of a film of said oil on a desired surface, and to drain oil from said applicator tip back into said container.

3. An applicator device for applying a film of oil, said device including a container having a top wall, and an applicator assembly connected thereto:

said applicator assembly including a vertical tube extending upwardly through said top wall of said container, a concave upward drain receptacle mounted on said tube in sealing engagement therewith and extending radially therefrom above said container, and a porous applicator tip over the outer end of said tube and on said drain receptacle, said tube being in fluid communication with said drain receptacle, said drain receptacle extending radially outward of said applicator tip;

said applicator tip having a periphery with a convex portion for application of oil to extended surfaces, and a concave portion for application of oil to grill rods and the like;

whereby said applicator device is effective to provide oil to said applicator tip for application of a film of said oil on a desired surface, and to drain oil from said applicator tip back into said container.

* * * * *